US005430995A

United States Patent [19]

Ceré

[11] Patent Number: 5,430,995

[45] Date of Patent: Jul. 11, 1995

[54] UNIT FOR HEAT-SEALING PLASTIC FILM USED TO WRAP PALLETIZED STACKS OF COMMODITIES

[75] Inventor: Mauro Ceré, Loiano, Italy

[73] Assignee: Robopac Sistemi S.r.l., Rimini, Italy

[21] Appl. No.: 139,420

[22] Filed: Oct. 20, 1993

[30] Foreign Application Priority Data

Nov. 12, 1992 [IT] Italy ..... BO92A0405

[51] Int. Cl.[6] ..... B65B 11/02; B65B 11/04; B65B 51/10; B65B 53/00

[52] U.S. Cl. ..... 53/556; 53/587; 53/588; 53/375.9

[58] Field of Search ..... 53/210, 211, 556, 587, 53/588, 375.9

[56] References Cited

U.S. PATENT DOCUMENTS

| | | | |
|---|---|---|---|
| 4,216,640 | 8/1980 | Kaufman | 53/587 X |
| 4,563,863 | 1/1986 | Humphrey | 53/587 X |
| 4,619,102 | 10/1986 | Geisinger . | |
| 4,747,252 | 5/1988 | Kapke | 53/588 X |
| 5,005,335 | 4/1991 | Yourgalite et al. | 53/588 X |
| 5,088,270 | 2/1992 | Diehl | 53/588 X |

FOREIGN PATENT DOCUMENTS

| | | | |
|---|---|---|---|
| 92830107.6 | 3/1992 | European Pat. Off. . | |
| 3615450 | 11/1987 | Germany | 53/556 |
| 2069967 | 2/1981 | United Kingdom . | |

*Primary Examiner*—Linda B. Johnson

*Attorney, Agent, or Firm*—Fay, Sharpe, Beall, Fagan, Minnich & McKee

[57] ABSTRACT

The end of a length of stretch film enveloping a pallet is restrained, prior to being heat-sealed, by a gripping mechanism that can be traversed toward and away from the pallet, and is capable of contracting longitudinally in a direction parallel to the plane occupied by the tail end of the film, transversely to the wrapping direction, from a position of engagement in which the gripping surfaces are spaced apart and uniformly in contact with the film over its maximum width, to a position of restraint in which the selfsame surfaces are drawn together, pinching the film to produce a uniform succession of folds and thus narrowing the material to a width that can be accommodated fully by the heat-seal plate.

6 Claims, 3 Drawing Sheets

UNIT FOR HEAT-SEALING PLASTIC FILM USED TO WRAP PALLETIZED STACKS OF COMMODITIES

BACKGROUND OF THE INVENTION

The present invention relates to a unit for heat sealing plastic film material as used in machines for wrapping palletized stacks of commodities. There are currently numerous machines of the type in question available for purchase, consisting generally of a load-bearing frame of gantry type construction, and a beam of upturned 'L' profile suspended rotatably from the center of the frame by the horizontal member of the 'L' and set in motion by a drive system. The vertical member of the 'L' carries a station serving to support a roll of the plastic wrapping film; as a rule this same station is also capable of a controlled sliding movement on the vertical member of the beam so that the stacked commodities can be enveloped to their full height. The palletized stacks of commodities for wrapping are positioned at the center of the machine, or rather the center of the gantry, either by a pallet lift truck (in the case of more simple equipment), or by means of a permanently installed horizontal conveyor running at floor level directly beneath the gantry; once the pallet is at a standstill in the required position, a restraint device is activated in such a way as to descend and stabilize the entire pallet load by engaging the top face of the stack of commodities. Thereupon, the free end of the film is secured to the pallet base or held fast by means of a gripper mechanism, and the drive system is activated: the upturned 'L' beam begins circling the pallet, and the stacked commodities are enveloped gradually by the uncoiling film. Where the width of the film is less than the height of the stacked commodities (as will normally be the case), the roll of film naturally must be made to ascend and descend on the vertical member of the beam in order to ensure that the commodities are enveloped entirely from top to bottom after a given number of overlapping turns have been effected to obtain the required compaction.

In an improved machine disclosed in European Patent application n. 92830107.6 (by the same applicant) and illustrated in the accompanying FIG. 1 for ease of description, the horizontal member R of the 'L' beam T is again rotatable about a vertical axis V in such a way as to allow of wrapping commodities P stacked on the pallet Pa, but positioned beneath the roll B of plastic wrapping film; more exactly, the horizontal member R rotates in a plane between a supporting frame I and a platform A on which to stand the pallet Pa, in such a way as to establish a center of rotation coinciding low in the machine with the vertical axis V, about which the beam T is driven in a first direction denoted S1 in FIG. 2. The machine also comprises means M by which the platform A, and with it the entire pallet load, is set in rotation about the same vertical axis V in the opposite direction S2 to that of the beam. In most instances the plastic film is drawn taut during the wrapping operation (by the application of a braking action to the roll), in order both to minimize the outlay on materials, and to increase the tension of the wrapping with the end in view of obtaining a greater tightness, especially where the commodities are stacked high.

All of the machines referred to above are equipped with units by which the tail end of the film is cut and secured to the pallet, or heat-sealed to the wrapping layer beneath. In the case of a heat-seal (the method to which the disclosure specifically relates), such units comprise a support encased by a housing and designed to emit a reaction element positioned substantially to the side of the space occupied by the rotating pallet, placed along the path of the film and serving as a striker for the heat-seal plate, which is followed in the direction of rotation by the cutter.

Conventionally, the height of the heat-seal unit is kept within rational limits by reducing the width of the wrapping film along a portion of the tail end immediately before the sealing operation takes place, through the agency of a restraining element embodied typically as a hook capable of movement in the vertical direction; with the horizontal member of the 'L' frame at standstill, the top edge of the film is intercepted by the hook and drawn downwards in such a way as to gather the deformable film and thus reduce its width, whereupon heat is applied to seal the gathered portion and secure the wrapping over the pallet.

Such a unit betrays certain drawbacks nonetheless, attributable in part to the limited space afforded by the plane of operation in which the various elements mentioned above are mounted and required to function; this can indeed be a critical factor in allowing the smooth and precise operation of the solution illustrated in FIG. 1, where there are two planes in contrarotation. A further negative factor is discernible in the use of the moving hook type element, which tends always to be imprecise when engaging the film, being liable either to penetrate the wrapping layers already in place or to tear the tail end of the film itself, given that the hooking action is not applied uniformly across the width of the film but concentrated on the higher side.

Accordingly, the object of the present invention is to overcome the drawbacks mentioned above through the adoption of a solution in which the tail end of a plastic wrapping film is gathered and heat-sealed by a unit featuring compactness in relation to the space afforded by the operating plane, and capable of exerting a precise and uniform grip on the film to bring about the necessary reduction in width.

SUMMARY OF THE INVENTION

The stated object is realized in a unit for heat-sealing plastic film of the type in which pallets are wrapped by a machine typically comprising a frame, and rotating on the frame, an 'L' profile beam supporting a roll of the plastic film material rotatable about its own vertical axis and capable of controlled ascending and descending movement on the vertical member of the 'L'; the machine also comprises a horizontal platform on which the loaded pallets are positioned, and, associated with the platform, means by which the ends of the film are secured to the pallet at the start and finish of the wrapping operation.

According to the invention, such securing means comprise: a reaction element capable of rotation from a horizontal at-rest position to a vertical operating position, interposed between the tail end of the film on one side and an already enveloped lower portion of the stack of commodities on the other; a restraining element, positioned adjacent to the reaction element and capable at least of a vertical movement whereby the film is gathered transversley and reduced from its maximum width to a selected minimum width while remaining uniformly gathered; and a heater-cutter element, positioned between the reaction element and the restraining element, by which the film is heat-sealed and cut across its uniformly reduced width to secure the wrapping around the pallet.

To advantage, the restraining element consists in gripping means positioned laterally alongside and extending uniformly distributed across the width of the film, and translatable toward and away from the loaded pallet, of which the maximum longitudinal dimension, disposed parallel to the plane occupied by the tail end of the film and concurrent with the width dimension, can be reduced by a movement from a position of engagement, in which the gripping surfaces are at their maximum extension and offered uniformly in contact to the film across its full width, to a position of restraint in which the gripping surfaces are at their minimum extension and the film is gathered uniformly and reduced to the selected minimum width.

BRIEF DESCRIPTION of the DRAWINGS

The invention will now be described in detail, by way of example, with the aid of the accompanying drawings, in which.

DESCRIPTION OF THE PREFERRED EMBODIMENTS

Figure 1:
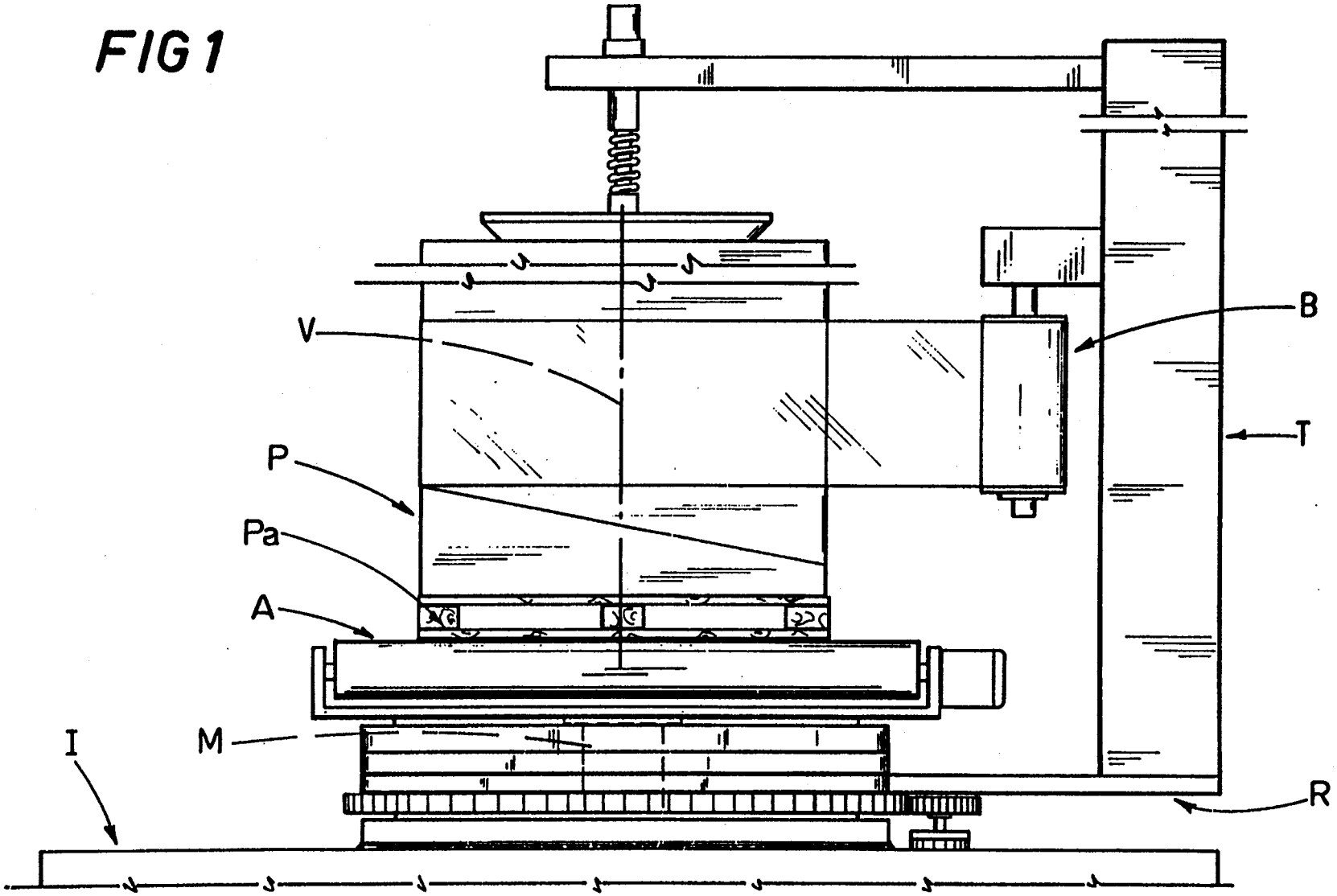
FIG. 1 shows a machine of conventional embodiment for wrapping palletized commodities, viewed in side elevation, to which the heat-seal unit according to the present invention can be fitted.

With reference to the drawings, the heat-seal unit to which the present invention relates is designed to operate in a machine for wrapping palletized commodities essentially comprising a frame 1, also a beam 2 of 'L' profile mounted pivotably to the frame 1 and driven in a first direction of rotation denoted S1 (see FIG. 2) by means of a geared motor (not illustrated); the 'L' beam 2 is composed of a vertical member 3 and a horizontal member 11, of which the vertical member 3 affords support to a roll 4 of stretch plastic film 5 mounted in such a way as to rotate about its own vertical axis and capable also of a controlled sliding movement in the vertical direction, which is produced by means not illustrated in the drawings (being conventional and forming no part of the invention).

The frame 1 also supports a horizontal platform 6 on which to position a pallet base 7 stacked with commodities 8; in the example of the drawings, the horizontal platform incorporates a roller table 34, and to one side of the table, means denoted 10, in their entirety, of which the purpose is to secure the leading end of the film 5 to the pallet as the wrapping operation commences, also to secure and cut the tail end C once the wrapping operation has been completed. Such securing means 10 occupy a position substantially at the outer periphery of the horizontal platform 6, which in the solution illustrated is rotatable on the frame 1 about the vertical axis V in the manner of the 'L' beam 2, though in the opposite direction S2 (as described in EP application 92830107.6 mentioned above), and are composed essentially of: a reaction element 12, a restraining element 13 serving to bring about a reduction in the width L of the tail end C of the film 5, and a heater-cutter element 14 by which the film is sealed and guillotined. The fact that the platform 6 is shown in a rotatable embodiment with the securing means 10 mounted permanently to the periphery implies no limitation of the unit to this type of application exclusively.

More exactly (see FIG. 2), the reaction element 12 exhibits a 'U' profile when seen in section, and is capable of movement within a plane parallel to the vertical dimension of the stack of commodities 8 (see arrow F), produced by a cylinder 27 of which one end is connected pivotably to the base of the element 12 itself and the other end to a housing 19 accommodating the entire heat-seal unit, rotating between an at-rest position, horizontally disposed, and a vertical operating position flanked by an already enveloped lower portion of the stack of commodities 8 on the one hand, and the tail end C of the film 5 on the other.

The heater-cutter element 14 occupies a position in practice between the reaction element 12 and the restraining element 13, and is designed to operate when the film 5 assumes a narrowed configuration to the end of securing the wrapping; the element 14 in question is conventional in embodiment, consisting essentially in a flat heated plate, denoted **14*p*, and a cutter 14*c* mounted to one side of the plate. The heater-cutter element 14 likewise is associated with a respective cylinder 28, anchored by the rod end to the element 14 itself and by the remaining end to the housing 19, and rotatable in a direction perpendicular to that of the reaction element 12 (see arrow F1, FIG. 2**).

The function of the restraining element 13, which occupies a position substantially alongside the reaction element 12 and has freedom of both axial and angular movement, is to bring about a reduction in the width of the film 5 from the maximum value L down to a minimum value denoted 1 reflecting the gathered condition of the material.

In effect, the restraining element 13 consists in a gripping assembly, or means, extending laterally to the film 5 and across its width L, and, where appropriate, capable of movement toward and away from the film; the restraining element 13 is also embodied in such a way as to allow of reducing its maximum dimension in the longitudinal direction, that is, parallel to the plane occupied by the tail end C of the film 5 and concurrent with the width L, from a position of engagement in which the gripping means are at their maximum extension and uniformly in contact with the tail end C of the film 5 at its maximum width L, to a position of restraint in which the gripping means are at their minimum extension and the width of the film 5 is reduced uniformly to the minimum value 1 aforementioned.

Figure 2:
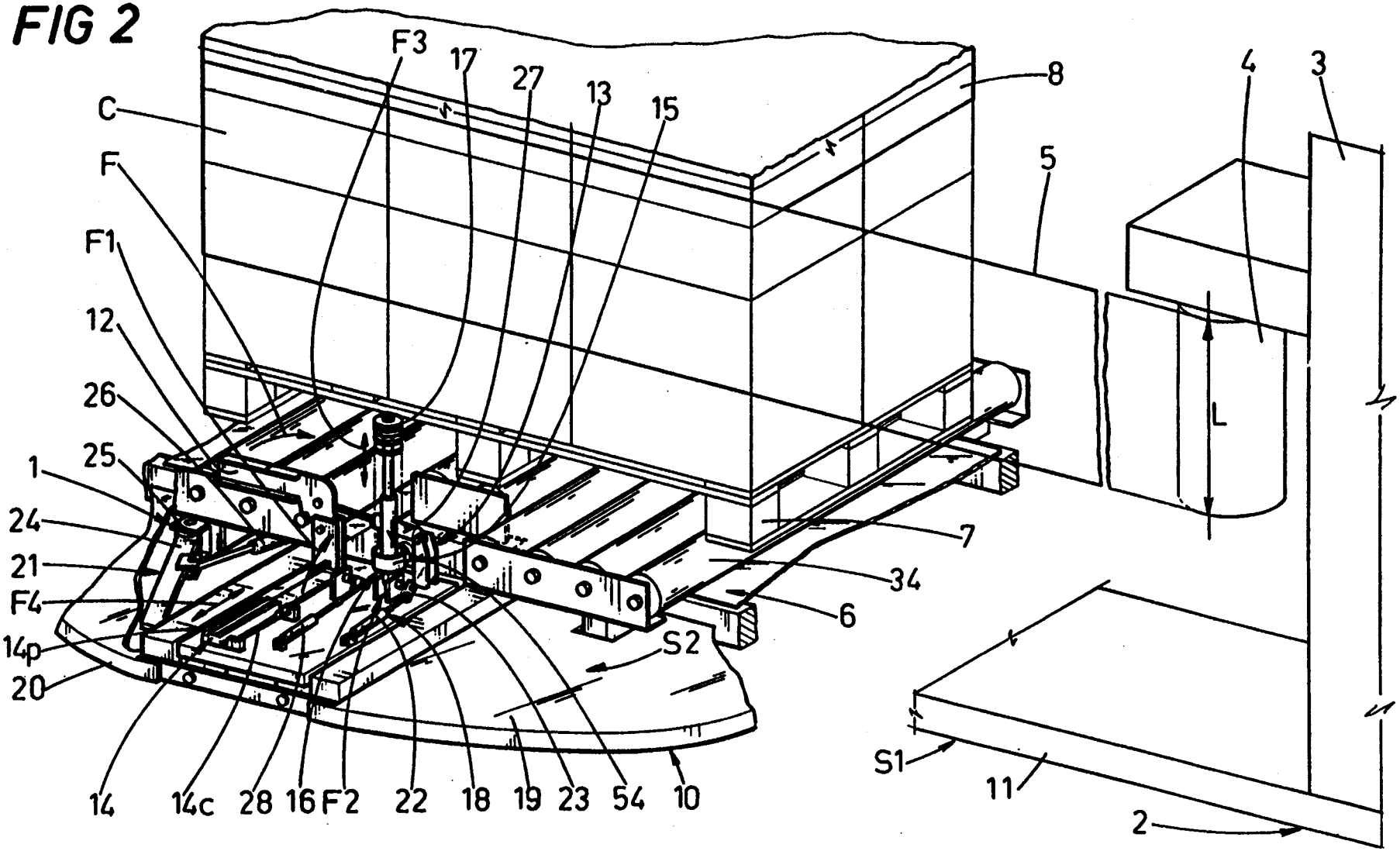
FIG. 2 is a perspective view of the heat-seal unit according to the invention, fitted to a machine as in FIG. 1, in which certain parts are omitted better to reveal others.
Figure 3:
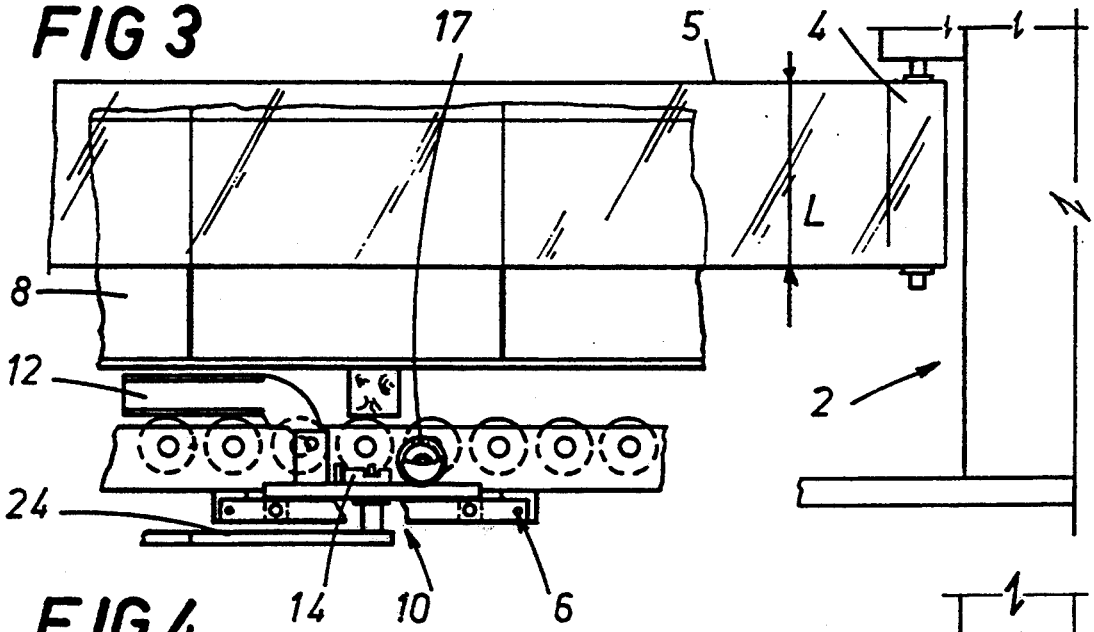
FIGS. 3, 4 and 5 are further side elevations, each showing a different operating configuration of the heat-seal unit, in which certain parts are omitted better to reveal others.

As discernible in FIG. 2, the gripping means 13 are composed of a cylindrical cupped base 54 supporting a telescopic cylinder 15 capable of extending and retracting axially through the agency of relative pneumatic means 16 (the cylinder will be connected by way of an air hose to rotary couplings not shown in the drawings, being incidental to the invention) between the aforementioned positions of maximum and minimum width, also a coil spring 17 ensheathing the cylinder 15 and rigidly associated by its ends respectively with the cupped base 54 and with the telescoping end of the cylinder 15 in such a manner as to favor a uniform contact between the film 5 and the single coils of the spring 17 during the passage from maximum to minimum extension, and thus bring about an evenly gathered reduction in width.

Also illustrated in FIG. 2 are actuator means 18 impinging on the cylindrical cupped base 54, by which the restraining element 13, and therefore the gripping means, can be rotated between a position horizontally disposed and distanced from the tail end C of the film 5, and a vertical position close to the film 5; such means 18 consist in a relative cylinder 22 connected to the cupped base 54 by way of a first lever 23, disposed in such a manner as to permit of rotating the gripping means between the two positions in question.

The three primary components of the heat-seal unit, namely the reaction element 12, the restraining element 13 comprising the telescopic cylinder 15 and coil spring 17, and the heater-cutter element 14, are accommodated internally of the housing 19 (in effect, a baseplate with protective vertical walls), which in its turn is mounted slidably to an overhung portion 20 of the horizontal platform 6 and associated with means 21 by which to adjust the distance of the unit from the stacked commodities 8 according to the shape or dimensions of the loaded pallet.

Such adjustment means 21 comprise a second lever 24 of 'L' profile connected by its ends respectively to a fixed anchorage 5 projecting from beneath the horizontal platform 6 and to the bottom surface of the housing 19, and a relative cylinder 26 of which the rod end is attached to an intermediate point along the second lever 24 and the remaining end to the horizontal platform 6, in such a way that the rotation of the second lever 24 has the effect of translating the housing 19 toward and away from the pallet (arrow F4 in FIG. 2).

The operation of the heat-seal unit will now be described.

The initial steps in the process of wrapping the stack of commodities 8 are familiar and therefore not described. Marginally before the application of the penultimate turn of wrapping film 5 around the lower portion of the stack, the reaction element 12 is raised to the vertical operating position (see arrow F in FIG. 2), and thus interposed between the already enveloped commodities 8 and the final two layers of film 5.

Figure 4:
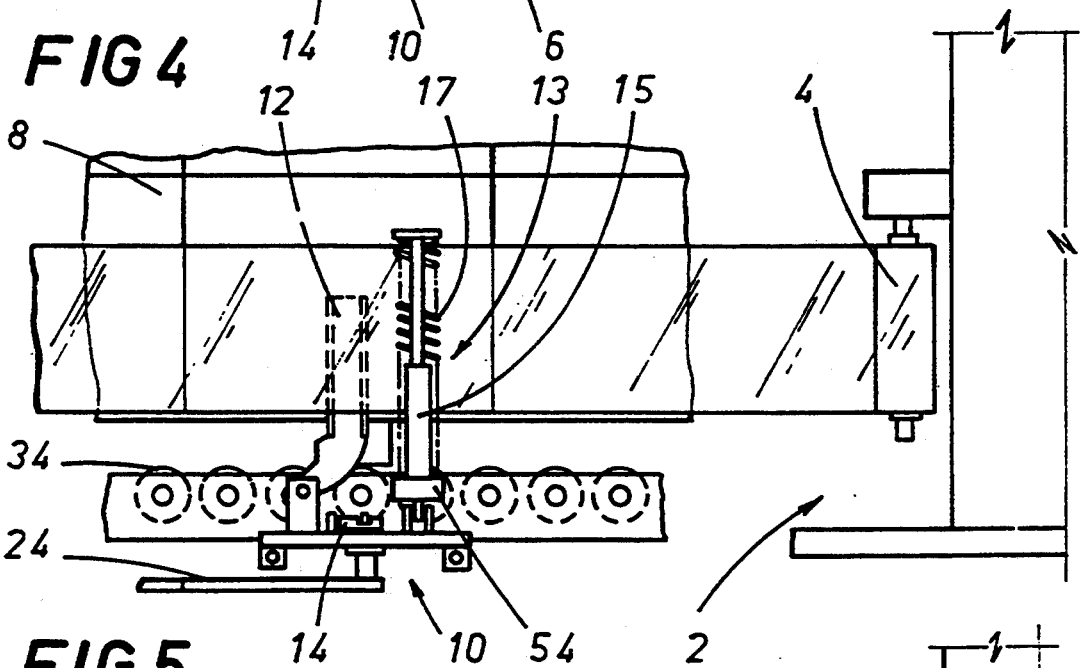
Figure 5:
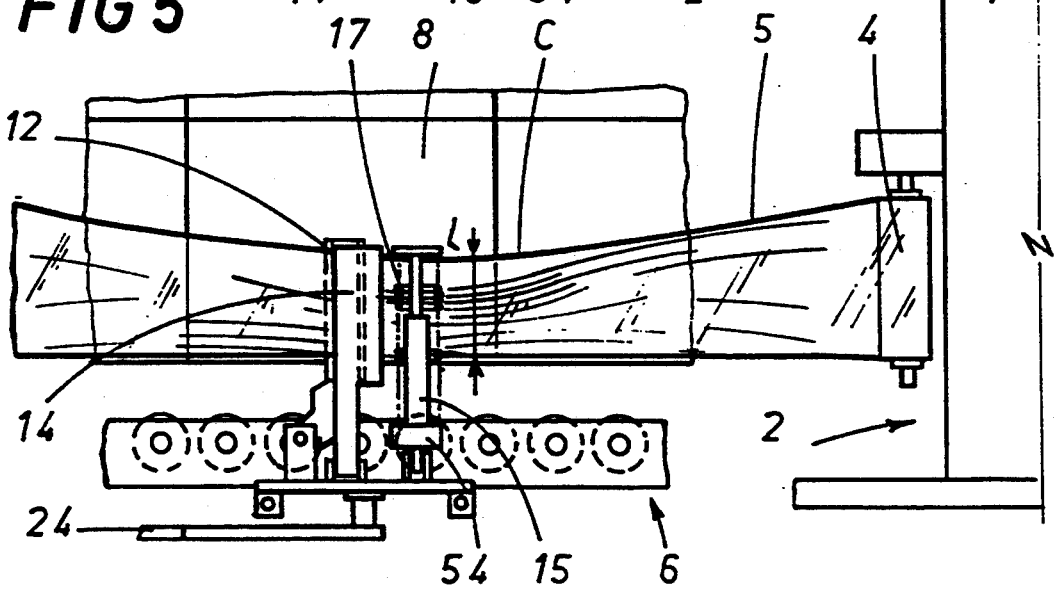

Once the platform 6 and the 'L' beam 2 have ceased rotation, the restraining element 13 is rotated up toward the tail end C of the film 5 (see arrow F2, FIG. 2) and the spring 17 extended at the same time by the telescopic cylinder 15 (arrow F3, FIG. 2); at this point the spring 17 is positioned tangentially to the tail end C of the film 5, in uniform contact across the full width L (FIG. 4). The cylinder 15 then retracts, compressing the spring 17, with the result that the film is pinched between the coils and gathered in, and the width of the tail end C reduced to the minimum value 1 indicated in FIG. 5.

With the tail end C of the film 5 thus uniformly gathered, the heater-cutter element 14 rotates into the vertical position (arrow F1, FIG. 2), whereupon the narrow portion of the tail end C is heat-sealed to the penultimate wrapping layer beneath and cut, with the assistance of the stable surface afforded by the reaction element 12. This done, the reaction element 12 and the heater-cutter element 14 return to their lowered positions, allowing the stack of commodities 8 to leave the palletizing area, whilst the restraining element 13 can remain upright until a new pallet has been brought into place so as to assist in securing the cut end C of the film, which now becomes the leading end of a further wrapping.

The heat-seal unit described and illustrated will be seen to consist in an assembly of components that features extreme compactness in the vertical dimension, signifying limited mass when all the components in question are disposed in the at-rest configuration, and is therefore especially suitable for application to contrarotating pallet-wrappers of the type referred to in the specification.

The expedient of the coil spring has the advantage of generating a sure grip on the wrapping film, and in consequence an optimum and uniform reduction in width with no risk of the material breaking at any stage of operation.

What is claimed:

1. A unit for heat-sealing plastic film for use in wrapping palletized stacks of commodities where a leading end of plastic film material is secured to a palletized stack of commodities at initiation of a wrapping operation and a tail end sealed and cut on completion of the operation, the unit comprising:

a frame;

a beam of 'L' profile including a horizontal member and a vertical member anchored to and driven in rotation on the frame, the vertical member supporting a roll of the plastic film material rotatable about a vertical axis and capable of controlled ascending and descending movement on the vertical member;

a horizontal platform on which the stack of commodities stands;

a reaction element rotating between an at-rest position, disposed substantially horizontal and level with the platform, and an operating position disposed substantially vertical, and flanked by the tail end of the film material on a first side and an already enveloped lower portion of the stack of commodities on a second side;

a restraining element positioned adjacent to the reaction element, between the reaction element and the roll of film material when the platform and beam are positioned for heat sealing, including a gripping assembly positioned laterally alongside and uniformly distributed across a width of the film material, translatable toward and away from the palletized stack of commodities on the platform, and having a maximum longitudinal dimension disposed parallel to a plane occupied by the tail end of the film material and corresponding to the width, the assembly being movable from a position of engagement in which the gripping assembly is at a maximum extension and uniformly in contact with the film across a maximum width, to a position of restraint in which the gripping assembly is at a minimum extension and the film is gathered uniformly and reduced in width to a minimum value, the width of the film being reduced as a result of the movement of the gripping assembly from the engagement to the restraint position; and, a heater-cutter element, positioned between the reaction element and the restraining element, by which the film is heat-sealed and cut while in a gathered configuration so as to complete wrapping of the stack of commodities and secure the film material.

2. The unit as set forth in claim 1, wherein the gripping assembly includes a telescopic cylinder capable of extending and retracting axially between the maximum width and the minimum width, a coil spring ensheathing the cylinder, the coil having ends anchored respectively to a cylindrical cupped base and to the telescoping end of the cylinder in such a way as to favor a uniform contact between the film material and single coils of the spring during passage from maximum to minimum extension, and an actuator associated with the cylindrical base, by which the cylinder and spring are rotated between a horizontal position, distanced from the tail end of the film material, and a vertical position close to the tail end of the film material.

3. The unit as set forth in claim 1, further comprising:

a housing having disposed therein the reaction element, the restraining element and the heater-cutter element, the housing being mounted slidably to a portion of the horizontal platform; and, adjustment means to adjust a distance of the housing from the stack of commodities according to size or geometry of the stack.

4. The unit as set forth in claim 2, wherein the actuator includes a cylinder, connected to a first lever anchored to the cylindrical base to allow rotation between the horizontal and vertical positions respectively distanced from and close to the film material.

5. The unit as set forth in claim 3, wherein the adjustment means includes an angled second lever, of which opposite ends are connected respectively to a fixed anchorage projecting from beneath the horizontal platform and to a bottom surface of the housing, and a cylinder of which a rod end is attached to an intermediate point along the second lever and a remaining end to the horizontal platform, in such a way that rotation of the second lever occasions translation of the housing toward and away from the pallet.

6. The unit as set forth in claim 1, wherein the horizontal platform and the 'L' beam are rotatable about a common axis in opposing directions, the reaction element, the restraining element, and the heat-cutter element being associated with a periphery of the platform on one side.

* * * * *